US005762049A

United States Patent [19]

Jones et al.

[11] Patent Number: 5,762,049

[45] Date of Patent: Jun. 9, 1998

[54] FUEL SUPPLY APPARATUS FOR MOTOR VEHICLE

[75] Inventors: Dale Richard Jones, Flushing; Wayne Frederick Harris, Lapeer; Ulf Sawert, Grand Blanc, all of Mich.

[73] Assignee: General Motors Corporation, Detroit, Mich.

[21] Appl. No.: 883,645

[22] Filed: Jun. 27, 1997

[51] Int. Cl.[6] ..... F02M 37/04

[52] U.S. Cl. ..... 123/514; 123/509; 137/565; 417/363

[58] Field of Search ..... 123/509, 514, 123/516; 137/590, 565; 417/363, 364

[56] References Cited

U.S. PATENT DOCUMENTS

| | | | |
|---|---|---|---|
| 4,651,701 | 3/1987 | Weaver | 417/363 |
| 4,694,857 | 9/1987 | Harris | 417/363 |
| 4,945,884 | 8/1990 | Coha et al. | 123/509 |
| 4,972,875 | 11/1990 | Beer | 123/514 |
| 5,046,471 | 9/1991 | Schmid | 417/363 |
| 5,110,265 | 5/1992 | Kato | 417/363 |
| 5,195,494 | 3/1993 | Tuckey | 123/514 |
| 5,361,742 | 11/1994 | Briggs et al. | 123/506 |
| 5,392,750 | 2/1995 | Laue et al. | 123/509 |
| 5,482,444 | 1/1996 | Coha | 417/363 |
| 5,623,907 | 4/1997 | Cotton | 123/514 |
| 5,647,330 | 7/1997 | Sawert | 123/509 |
| 5,649,514 | 7/1997 | Okada | 123/509 |
| 5,680,847 | 10/1997 | Begley | 123/509 |

FOREIGN PATENT DOCUMENTS

| | | |
|---|---|---|
| 0 678 664 A2 | 10/1995 | European Pat. Off. . |
| WO 95/29075 | 11/1995 | WIPO . |

*Primary Examiner*—Carl S. Miller
*Attorney, Agent, or Firm*—Saul Schwartz

[57] ABSTRACT

A fuel supply apparatus for a motor vehicle including a plastic canister, three evenly-spaced tubular struts on the canister, a plastic cover, a regulator pod on the plastic cover, and a pair of sockets on the cover and a socket on the regulator pod defining three evenly-spaced sockets on the cover adapted for plug-in reception of the tubular struts. The canister is inserted into a fuel tank of the motor vehicle through an access port. The cover closes the access port. A fuel pump in the canister delivers fuel to a high pressure conduit outside of the fuel tank through a high pressure fluid connector on the cover. A branch from the high pressure conduit is connected to a return fluid connector on the cover. The regulator pod has a return passage from the return fluid connector to the aforesaid socket on the regulator pod. A modular pressure regulator selectively unblocks the passage in the regulator pod to regulate fluid pressure in the high pressure supply side by recirculating a fraction of the fuel in the high pressure conduit back to the canister through the one of the tubular guides plugged into the socket in the regulator pod.

4 Claims, 3 Drawing Sheets

FUEL SUPPLY APPARATUS FOR MOTOR VEHICLE

TECHNICAL FIELD

This invention relates to a fuel supply apparatus for a motor vehicle.

BACKGROUND OF THE INVENTION

A fuel supply apparatus for a motor vehicle is described in U.S. Pat. No. 4,945,884, issued Aug. 7, 1990 and assigned to the assignee of this invention, and includes a plastic canister, a plurality of evenly-spaced tubular struts slidable up and down on the canister, a plastic cover, and a corresponding plurality of evenly-spaced sockets on the cover into which the ends of the tubular struts are plugged. The canister is inserted into a fuel tank of the motor vehicle through an access port in the top of the tank. The cover closes the access port. A fuel pump in the canister delivers fuel to a high pressure conduit of the motor vehicle outside of the fuel tank through a high pressure fluid connector on the cover and a plastic hose inside the fuel tank between the pump and the high pressure fluid connector. Low pressure surplus fuel is returned to the canister through a return fluid connector on the cover and a passage in the cover which terminates in one of the sockets in the cover so that surplus fuel is conducted back into the canister through the tubular strut plugged into the aforesaid one of the sockets. Because the sockets and the struts are evenly spaced and because all of the struts are tubular, the cover can assume different angular orientations relative to the canister to accommodate different motor vehicle environments. A motor vehicle fuel supply apparatus according to this invention is a novel alternative to the fuel supply apparatus described in the aforesaid U.S. Pat. No. 4,945,884.

SUMMARY OF THE INVENTION

This invention is a new and improved fuel supply apparatus for a motor vehicle including a plastic canister, a plurality of evenly-spaced tubular struts slidable up and down on the canister, a plastic cover, a regulator pod on the plastic cover, and a pair of sockets on the cover and a socket on the regulator pod cooperating in defining a plurality of three evenly-spaced sockets on the cover adapted for plug-in reception of the tubular struts. The canister is inserted into a fuel tank of the motor vehicle through an access port in the top of the tank. The cover closes the access port. A fuel pump in the canister delivers fuel to a high pressure conduit of the motor vehicle outside of the fuel tank through a high pressure fluid connector on the cover and a plastic hose inside the fuel tank between the pump and the high pressure fluid connector. A branch from the high pressure conduit is connected to a return fluid connector on the cover. The regulator pod is mounted on an end of the return fluid connector inside of the fuel tank and defines a passage from the return fluid connector to the aforesaid socket on the regulator pod. A modular pressure regulator blocks the passage in the regulator pod and regulates the fluid pressure in the high pressure conduit by unblocking the passage to recirculate a fraction of the fuel in the high pressure conduit back to the canister through one of the tubular struts plugged into the socket in the regulator pod.

DESCRIPTION OF THE PREFERRED EMBODIMENT

Figure 1:
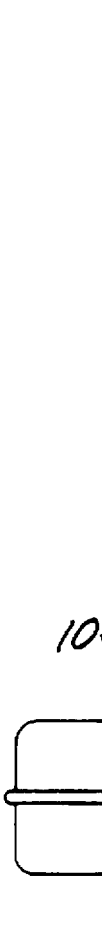
FIG. 1 is a partially broken-away view of a fuel tank of a motor vehicle having thereon a fuel supply apparatus according to this invention on the fuel tank.

Referring to FIG. 1, a fuel tank 10 of a motor vehicle, not shown, has a top panel 12 and a bottom panel 14. The top panel 12 has a circular access port 16 therein through which a fuel supply apparatus 18 according to this invention is installed in the fuel tank.

The fuel supply apparatus 18 includes a disc-shaped cover 20 which seals closed the access port 16 in the fuel tank 10 and a cup-shaped canister 22 in the fuel tank below the cover. A flat, disc-shaped retainer 24 is rigidly attached to the canister 22 and seated on an upper edge 26 of a generally cylindrical wall 28 of the canister. A fuel level transducer 30 is mounted on a bracket 32 rigidly attached to the canister. An electric fuel pump, not shown, such as described in U.S. Pat. No. 4,718,827, issued Jan. 12, 1988 and assigned to the assignee of this invention, is disposed in the canister. The fuel level transducer and the electric fuel pump are connected to a wiring harness of the motor vehicle through an electrical connector 34 on the cover 20.

A discharge port of the fuel pump, not shown, delivers fuel at high pressure to a fragmentarily illustrated high pressure conduit 36 outside of the fuel tank 10 through a high pressure fluid connector 38 on the cover 20 and a flexible hose 40 inside of the fuel tank between the fuel pump and the high pressure fluid connector. The high pressure fluid conduit 36 delivers high pressure fuel to a fuel injection system, not shown, of the motor vehicle. A small fraction of the high pressure fuel discharged from the fuel pump is diverted through a hose 42 inside of the fuel tank to a jet pump, not shown, in the canister 22 which aspirates fuel from the fuel tank into the canister.

Figure 2:
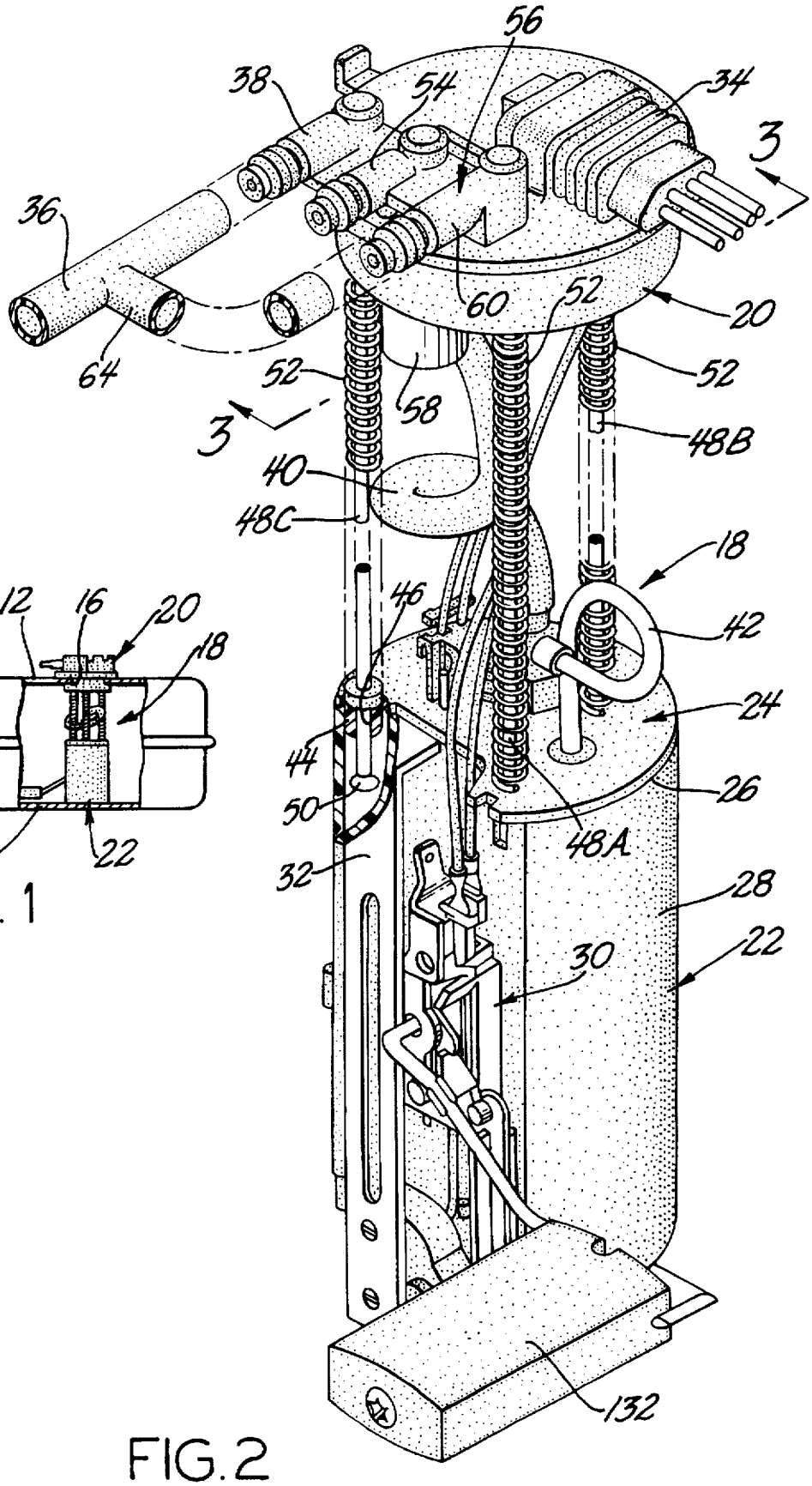
FIG. 2 is a partially broken-away perspective view of the fuel supply apparatus according to this invention.

As seen best in FIG. 2, the retainer 24 has a plurality of three tubular bosses thereon each having a cylindrical passage therethrough, only a representative tubular boss 44 having a representative passage 46 therethrough being visible in FIG. 2. The tubular bosses 44 and the passages 46 are evenly spaced or arrayed around a longitudinal centerline of the fuel supply apparatus at 120° angular intervals. A plurality of three tubular struts 48A, 48B, 48C of the fuel supply apparatus 18 are disposed in respective ones of the passages 46 for up and down linear reciprocation on the canister 22. Each strut has a flared inboard end 50 which cooperates with the corresponding one of the bosses 44 in preventing dislodgement of the strut from the canister. A plurality of coil springs 52 are loosely disposed around respective ones of the tubular struts 48A, 48B, 48C.

Figure 3:
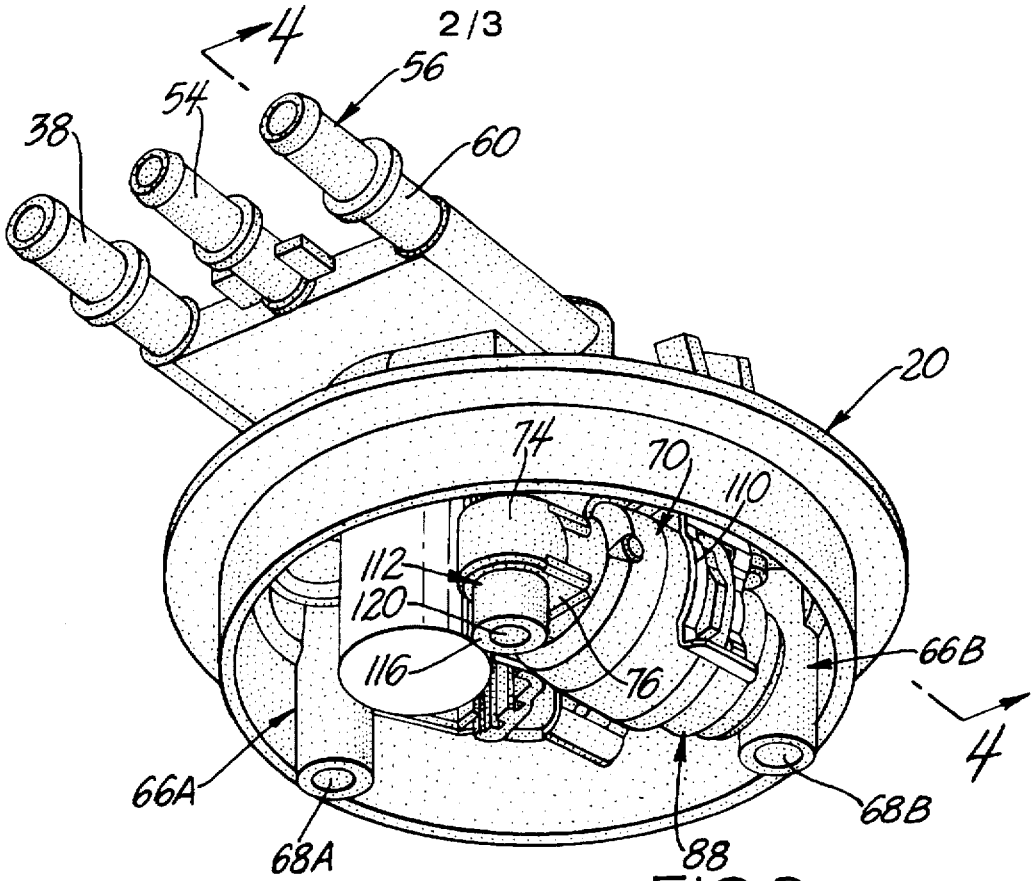
FIG. 3 is a perspective view taken generally along the plane indicated by lines 3—3 in FIG. 2.
Figure 4:
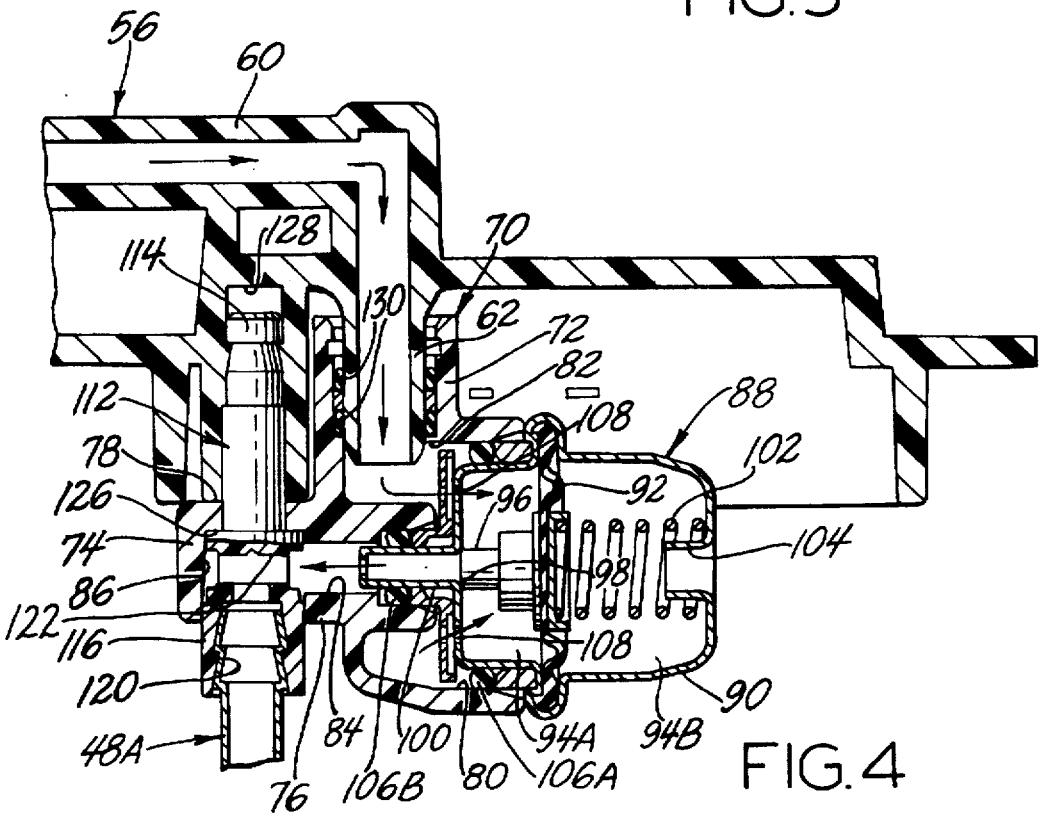
FIG. 4 is a sectional view taken generally along the plane indicated by lines 4—4 in FIG. 3.
Figure 5:
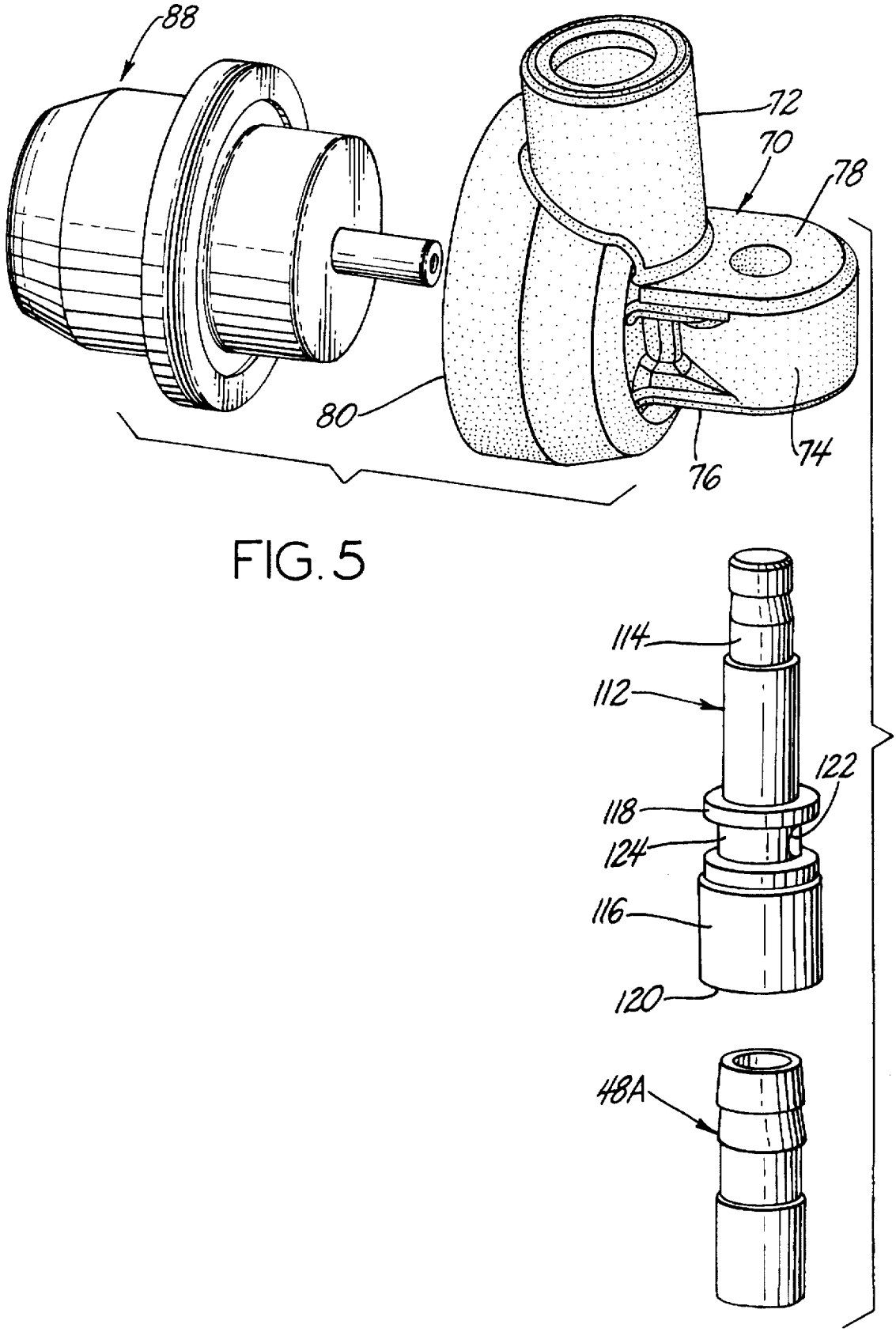
FIG. 5 is an exploded perspective view of a portion of the fuel supply apparatus according to this invention.

As seen best in FIGS. 3–5, the cover 20 of the fuel supply apparatus 18 further includes an integral vapor connector 54 and an integral return fluid connector 56. The vapor connector 54 communicates inside of the fuel tank with a vapor valve 58 on the cover 20 and outside of the fuel tank with a vapor hose, not shown, which conducts vapor from the fuel tank to a remote storage apparatus, not shown, on the motor vehicle. The vapor valve 58 closes when the canister is inverted. The return fluid connector 56 has a tubular outer end 60 outside of the fuel tank and a tubular inner end 62, FIG. 4, inside the fuel tank perpendicular to the cover 20. A branch 64 of the high pressure conduit 36 outside of the fuel tank is connected to the outer end 60 of the return fluid connector 56.

The cover 20 has a pair of integral tubular bosses 66A, 66B thereon defining respective ones of a pair of cylindrical sockets 68A, 68B facing the canister 22 and angularly spaced to match the angular separation between the cylindrical passages 46 in the tubular bosses 44 on the retainer 24, i.e., at an angular interval equal to 120°. Each of the cylindrical sockets 68A, 68B is adapted for plug-in reception of a distal or upper end of any one of the tubular struts 48A, 48B, 48C.

As seen best in FIGS. 3–5, a molded plastic regulator pod 70 of the fuel supply apparatus 18 includes a tubular boss 72, a generally rectangular boss 74 having a first flat side 76 and a second flat side 78, and a cylindrical regulator socket 80. A first internal passage 82 in the regulator pod 70 intersects the bottom of the tubular boss 72 and the bottom of the regulator socket 80. A second internal passage 84 in the regulator pod intersects the bottom of the regulator socket 80 and a stepped bore 86 in the rectangular boss 74 perpendicular to the flat sides 76, 78 of the latter. The first and second internal passages 82, 84 cooperate in defining a return passage in the regulator pod interrupted by the regulator socket 80.

As seen best in FIG. 4, a modular or unitized pressure regulator 88 of the fuel supply apparatus 18 includes a metal shell or housing 90 and a flexible diaphragm 92 dividing the housing into a pair of chambers 94A, 94B. A valve element 96 on the diaphragm 92 is biased against a valve seat 98 in the chamber 94A of the housing at one end of a tubular extension 100 of the housing by a spring 102 in the chamber 94B. The chamber 94B communicates with the fuel tank through a port 104 so that the chamber 94B is at substantially tank pressure.

The housing 90 seats in the regulator socket 80 with the tubular extension 100 in the second passage 84 in the regulator pod and with a pair of seals 106A, 106B between the regulator pod 70 and, respectively, the housing 90 and the tubular extension 100. A plurality of perforations 108 in the housing 90 afford communication between the chamber 94A and the first passage 82 in the regulator pod which intersects the bottom of the regulator socket. A C-shaped clip 110 prevents dislodgement of the unitized pressure regulator 88 from the regulator socket 80.

As seen best in FIGS. 4–5, a tubular guide 112 of the fuel supply apparatus 18 has a barbed small diameter cylindrical end 114 and a big diameter cylindrical end 116 separated from the small diameter end by an annular shoulder 118. The inside of the big diameter end 116 of the guide 112 defines a cylindrical socket 120. A cross bore 122 in the guide 112 intersects the cylindrical socket 120 and an annular groove 124 on the outside of the big diameter end 116. The guide 112 is interference fitted in the stepped bore 86 in the rectangular boss 74 of the pod 70 through the flat side 76 until the shoulder 118 on the guide seats against a corresponding annular shoulder 126, FIG. 4, of the stepped bore. The annular groove 124 in the guide faces the second passage 84 in the regulator pod where the second passage intersects the stepped bore.

The regulator pod 70 with the guide 112 and the unitized pressure regulator 88 thereon is rigidly attached to the cover 20 of the fuel supply apparatus 18 by concurrently plugging the small diameter cylindrical end 114 of the guide 112 into a cylindrical socket 128 in the cover and the inner end 62 of the return fluid connector 56 on the cover into the tubular boss 72 on the regulator pod until the flat side 78 of the rectangular boss 74 on the pod seats against the cover. An interference fit between the small diameter end 114 of the tubular guide and the socket 128 retains the regulator pod on the cover 20. A plurality of seal rings 130 prevent leakage of fluid between the regulator pod and the inner end 62 of the return fluid connector.

The position of the regulator pod 70 on the cover 20, as defined by the socket 128 and the inner end 62 of the return fluid connector 56, is calculated to locate the cylindrical socket 120 in the guide 112 symmetrically with respect to the pair of integral sockets 68A, 68B on the cover so that the sockets 68A, 68B cooperate with the socket 120 in defining a plurality of three equally angularly spaced sockets on the cover at the same radial distance from a longitudinal centerline of the canister. The cylindrical socket 120 in the guide 112 is also adapted to receive in plug-in fashion the distal end of any one of the tubular struts 48A, 48B, 48C so that the cover 20 is attached to the canister 22 by concurrently plugging into the cylindrical sockets 120, 68A, 68B the distal ends of respective ones of the tubular struts 48A, 48B, 48C.

With the tubular struts 48A, 48B, 48C plugged into the cylindrical sockets 120, 68A, 68B, the springs 52 bias the canister 22 against the bottom panel 14 of the fuel tank 10 so that the fuel level transducer 30 is bottom referenced. Importantly, because the cylindrical sockets 120, 68A, 68B are identical and equally spaced around the longitudinal centerline of the canister, the cover 20 may assume any of three angular positions relative to the canister to achieve an optimum orientation relative to the motor vehicle of the high pressure fluid connector 38, the vapor connector 54, and the return fluid connector 56 without disturbing the orientation of the canister 22 in the fuel tank which provides optimum clearance for a float 132 of the fuel level transducer 30. It is within the scope of this invention to achieve additional potential orientations of the cover 20 relative to the canister 22 by providing additional evenly-spaced sockets on the cover and correspondingly additional tubular bosses on the canister.

When the electric fuel pump in the canister 22 is on, fuel at the pressure prevailing in the high pressure conduit 36 is conducted to the chamber 94A of the modular pressure regulator 88 through the branch 64, the return fluid connector 56, the first passage 82 in the regulator pod 70, and the apertures 108 in the regulator housing 90. When the force on the diaphragm 92 induced by the fluid pressure in the chamber 94A exceeds the opposite thrust of the spring 102, the valve element 96 separates from the valve seat 98 to open a flow path to the canister 22 through the second passage 84 in the regulator pod, the cross bore 122 and the cylindrical socket 120 in the guide 112, and the tubular strut 48A. A fraction of the discharge of the electric fuel pump is thus diverted back to the canister 22 to maintain the pressure in the high pressure conduit at a magnitude determined by the spring rate of the spring 102. The lengths of the tubular struts 48A, 48B, 48C are calculated to submerge the flared inboard ends 50 thereof in fuel in the canister 22 when the latter is full to minimize foaming and vapor generation attributable to fuel diverted to the canister through the regulator pod 70.

Having thus described the invention, what is claimed is:

1. A fuel supply apparatus comprising:

a canister, a plurality of tubular struts supported on said canister at equal angular intervals around and for linear translation parallel to a longitudinal centerline of said canister, a cover, a plurality of sockets in said cover less than said plurality of tubular struts each adapted to receive in plug-in fashion one of said plurality of tubular struts in any one of a plurality of angular positions of said cover relative to said canister, a return fluid connector means on said cover, a regulator pod means having therein a socket adapted to receive in plug-in fashion one of said plurality of tubular struts and a return passage intersecting said socket, a modular pressure regulator on said regulator pod means selectively blocking said return passage, and means operative to mount said regulator pod means on said cover with said return passage in fluid communication with said return fluid connector and with said socket in said regulator pod means located to receive in plug-in fashion one of said plurality of tubular struts in any one of said plurality of angular positions of said cover relative to said canister so that fluid flowing in said return passage from said return fluid connector past said modular pressure regulator is conducted to said canister through said one of said tubular struts plugged into said socket in said regulator pod means.

2. The fuel supply apparatus recited in claim 1 wherein said return fluid connector means on said cover comprises:

a return fluid connector on said cover having a tubular inner end perpendicular to said cover.

3. The fuel supply apparatus recited in claim 2 wherein said regulator pod means having therein a socket adapted to receive in plug-in fashion one of said tubular struts and a return passage intersecting said socket comprises:

a plastic regulator pod having said return passage therein, a regulator socket in said plastic regulator pod intersecting said return passage and receiving in plug-in fashion said modular pressure regulator, a bore in said plastic regulator pod intersecting said return passage, a guide rigidly attached to said regulator pod in said bore therein with a tubular end of said guide defining said socket on said plastic regulator pod adapted to receive in plug-in fashion one of said tubular struts, and a cross bore in said guide operative to effect fluid communication between said tubular end of said guide defining said socket and said return passage in said plastic regulator pod.

4. The fuel supply apparatus recited in claim 3 wherein said means operative to mount said regulator pod means on said cover with said return passage in fluid communication with said return fluid connector and with said socket in said regulator pod means located to receive in plug-in fashion one of said plurality of tubular struts in any of said plurality of angular positions of said cover relative to said canister comprises:

an end of said guide projecting beyond said plastic regulator pod, a socket in said cover receiving with an interference fit said end of said guide projecting beyond said plastic regulator pod for retention of said plastic regulator pod on said cover, and a boss on said plastic regulator pod around an end of said return passage therein received around said tubular inner end of said return fluid connector on said cover.

* * * * *